US005893189A

United States Patent [19]

D'Costa

[11] Patent Number: 5,893,189

[45] Date of Patent: Apr. 13, 1999

[54] SWEEPING MACHINE WITH HOPPER SHELF

[75] Inventor: Joseph F. D'Costa, New Hope, Minn.

[73] Assignee: Tennant Company, Minneapolis, Minn.

[21] Appl. No.: 08/938,399

[22] Filed: Sep. 26, 1997

[51] Int. Cl.[6] ..... E01H 1/04

[52] U.S. Cl. ..... 15/83

[58] Field of Search ..... 15/83, 84, 85, 15/86

[56] References Cited

U.S. PATENT DOCUMENTS 3,668,730 6/1972 Scharmann ..... 15/83
4,041,567 8/1977 Burgoon ..... 15/83
5,295,277 3/1994 Koenigs ..... 15/83

*Primary Examiner*—Randall E. Chin
*Attorney, Agent, or Firm*—Dorn, McEachran, Jambor & Keating

[57] ABSTRACT

A sweeping machine has a body, wheels supporting the body, and a sweeping brush which is carried by the body and driven by a motor mounted on the sweeping machine. There is a debris hopper positioned adjacent the brush to receive debris moved by the brush toward the hopper. The hopper has a bottom, a front wall, and side walls, and there is a shelf in the hopper spaced above the bottom and attached to at least one of the walls. Debris moved by the brush toward the hopper is deposited on both the hopper bottom and the hopper shelf.

6 Claims, 2 Drawing Sheets

SWEEPING MACHINE WITH HOPPER SHELF

THE FIELD OF THE INVENTION

The present invention relates to sweeping machines of the type used to clean large areas such as factory floors, office buildings, parking lots and the like, and more specifically relates to an improvement in the debris hopper for such machines. The improvement described has application in sweeping machines per se and in machines which are a combination scrubber and sweeper.

In a machine which has both scrubbing and sweeping capability, the scrubbing function occupies most of the length of the machine, leaving very little length for the sweeper. This results in a short sweeper hopper with a limited capacity. Short hoppers are also found in compact sweepers built for use in smaller spaces. In all of them the sweeping brush will hurl sand and other debris against the front hopper wall, from where it builds up until it reaches the angle of repose, more or less 30 degrees for sand. Any additional debris, such as sand, which is thrown by the brush into the hopper simply slides back and out of the hopper entrance. For all practical purposes the hopper is full, but there is still a lot of space above the debris pile simply because the angle of repose will only allow the hopper to contain a limited amount of material. On larger sweepers, the hopper can be and is extended forward essentially as far as the brush can throw debris, but on compact sweepers the front hopper wall blocks the debris throw and only a limited amount of debris can be loaded.

Since debris such as sand is thrown into the interior of the hopper in more or less of a shotgun pattern, with much of the debris being thrown higher than the roughly 30 degree angle of repose of debris collected on the hopper bottom, the present invention provides added capacity in the form of a shelf within the hopper, attached to and extending between the hopper side walls. The shelf is located above the maximum height of debris on the hopper bottom when considering the 30 degree angle of repose. The shelf may be horizontal and attached to the side walls, it may be attached along one or both of the side walls and there may be multiple shelves. What is important is that there be additional capacity for debris over and above that provided by the hopper bottom.

SUMMARY OF THE INVENTION

The present invention relates to sweeping machines and more particularly to a sweeping machine having a hopper with enhanced storage capacity.

A primary purpose of the invention is a sweeping machine which has a debris hopper positioned adjacent the sweeping brush, with the debris hopper having a shelf for added capacity for storage of debris moved into the hopper by the rotating sweeping brush.

Another purpose of the invention is to provide a sweeping machine hopper which has capacity over and above that provided by the hopper bottom, with such additional capacity being derived from shelving positioned within the hopper and above the maximum height of debris collected on the hopper bottom.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
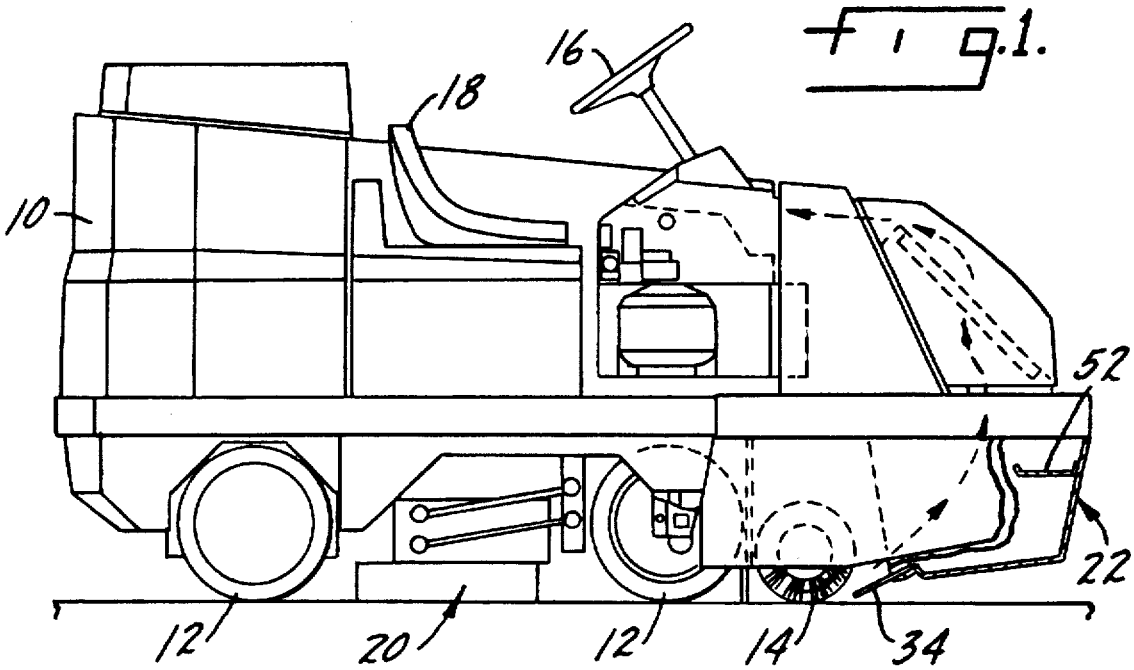
FIG. 1 is a side view of a combined sweeper and scrubber surface cleaning machine which incorporates the present invention.
Figure 2:
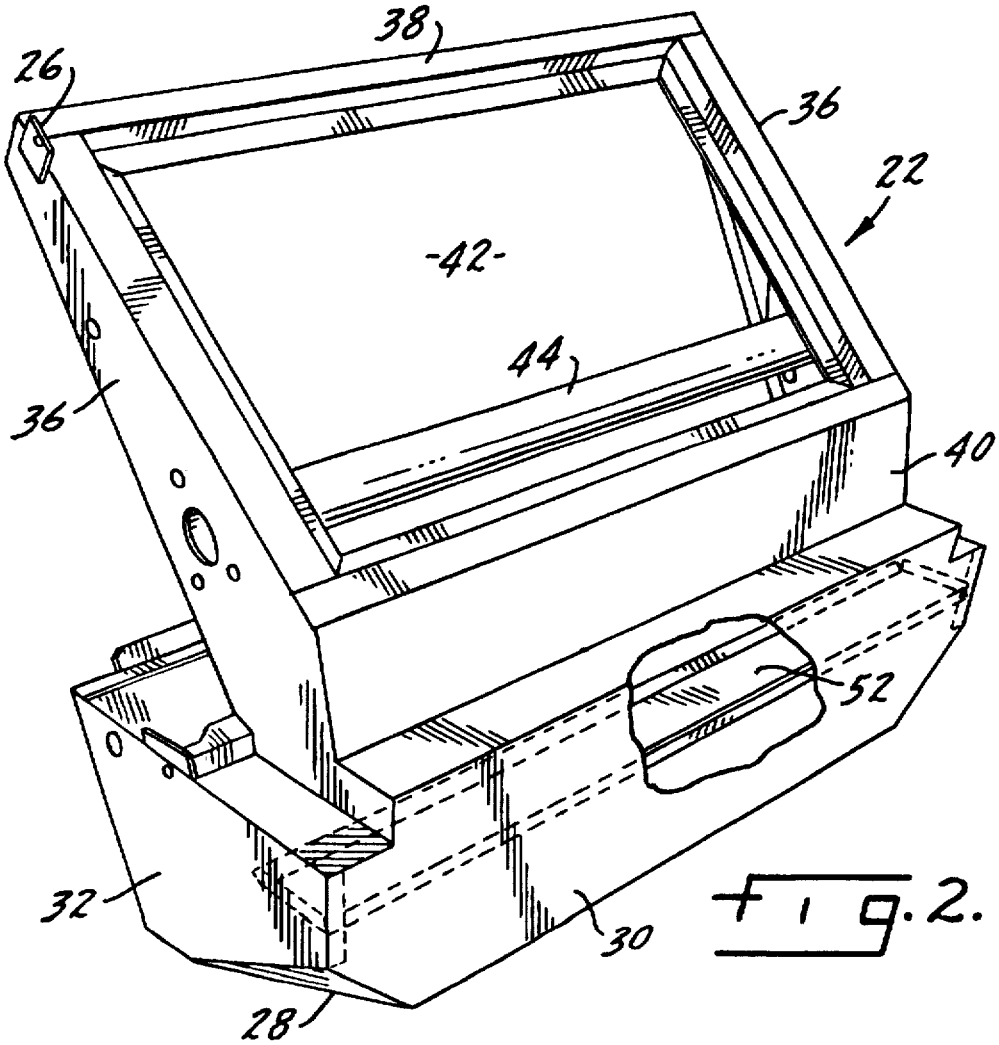
FIG. 2 is a perspective of the hopper used in the machine of FIG. 1.

FIG. 1 illustrates a surface cleaning machine which is a combination sweeper and scrubber. The invention is equally applicable to a machine which functions only as a sweeper, as the concepts described herein are primarily directed toward increasing the capacity of the hopper and such would be applicable to combination machines and to sweepers per se.

The machine illustrated in FIG. 1 includes a body 10 mounted on wheels 12 and having a rotating sweeping brush 14. The sweeping brush will be driven by a suitable motor on the machine shown in FIG. 1. There are the usual driver controls such as a steering wheel 16 and a driver's seat 18. The scrubbing portion of the machine is indicated generally by the designation 20 and will not be described in detail. It is sufficient for an explanation of the invention that the scrubbing portion of the machine is behind the sweeping portion, as it is necessary for the debris to first be removed from the surface being cleaned before the scrubbing function can be efficiently performed.

The machine of the present invention includes a hopper illustrated generally at 22 and shown in detail in FIGS. 2 through 5. The hopper is mounted on the front of the body 10 and debris from the sweeping brush 14 will be swept into the hopper along a trajectory between the dashed lines 48 and 50 in FIG. 3. The hopper 22 will be pivotally attached to the body 10 by mounting flanges 26 shown in FIGS. 2 and 3. When the hopper is so pivoted, it will be raised up and the debris will be deposited in a suitable container. This is known as a high dump sweeping machine.

The hopper 22 has a bottom 28, a front wall 30, and side walls 32. The bottom wall 28 may include a sweeping lip 34, shown in FIG. 1 and FIG. 3, and positioned directly adjacent the sweeping brush 14.

The hopper 22 includes a pair of vertically extending arms 36 attached together at their upper end by a cross member 38 and at their lower ends by a cross member 40. The arms 36 and the cross members 38 and 40 define a cavity 42 within which there will be positioned a conventional filter for the dust laden air that is traveling along the path of arrows 24. Such filter may also include suitable cleaning means if desired. A tube 44 extends through the cavity 42 and is journaled into the arms 36 and forms a part of the hopper and the assembly to raise the hopper when it is being dumped.

Figure 3:
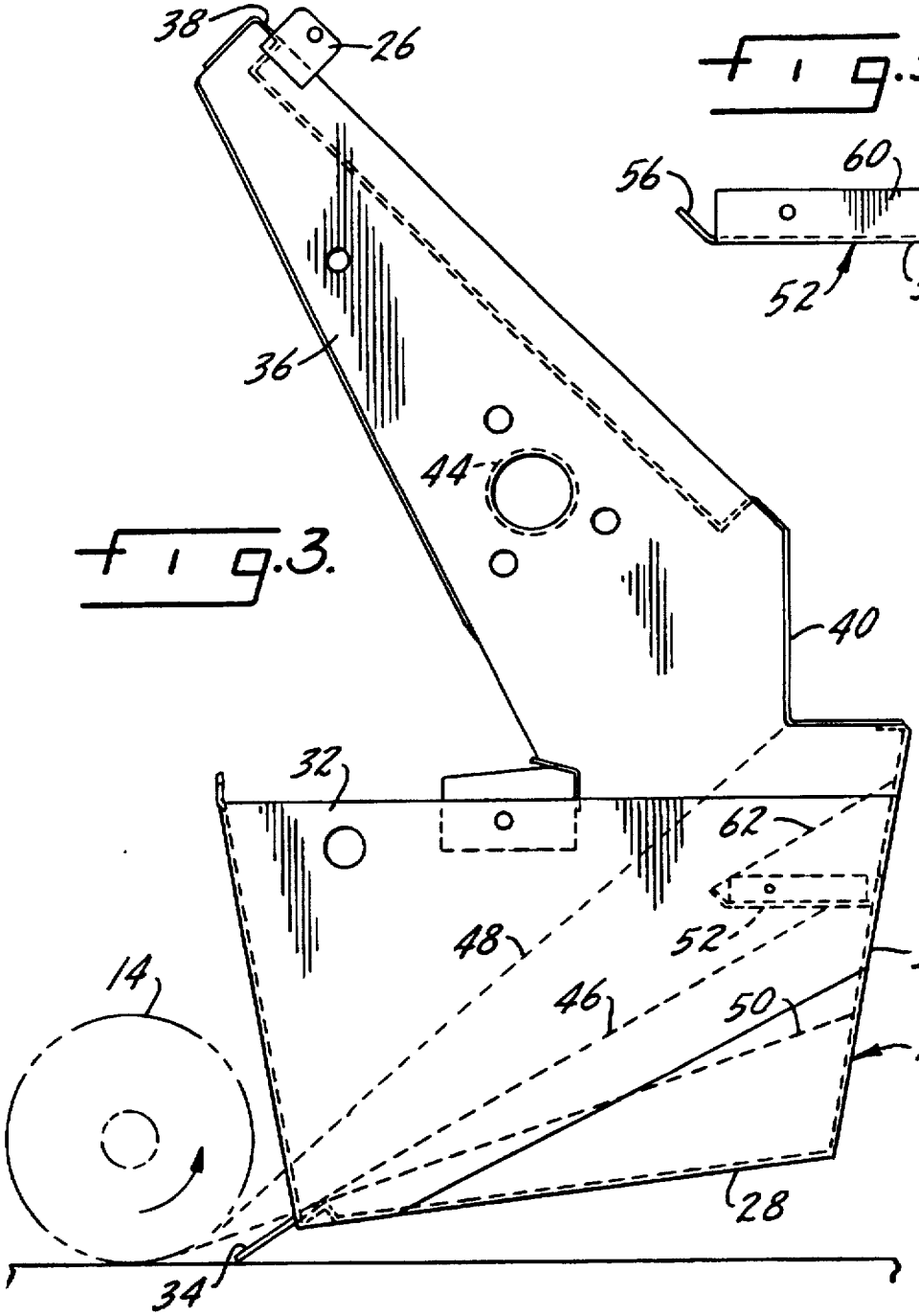
FIG. 3 is a side view of the hopper shown in position adjacent the sweeping brush.
Figure 5:
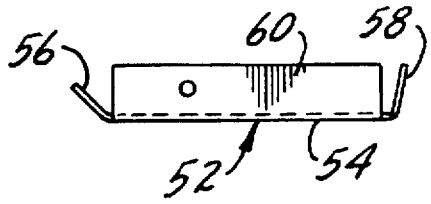
FIG. 5 is an end view of the hopper shelf.
Figure 4:
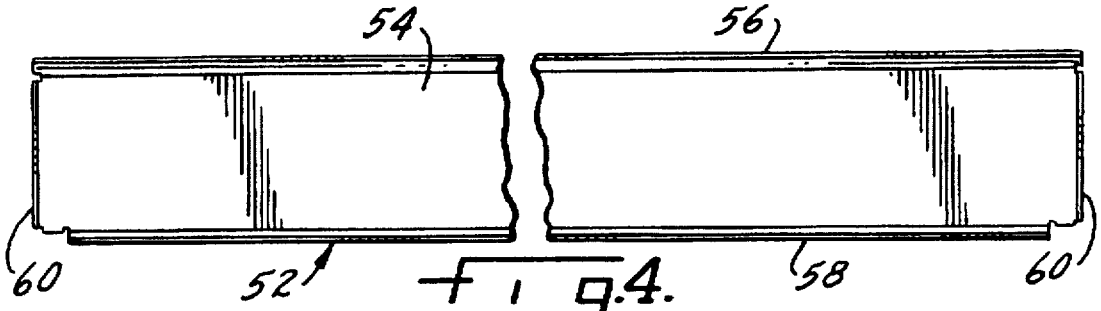
FIG. 4 is a plan view of the hopper shelf.

Focusing on FIG. 3, the line 46 indicates the height to which debris will be collected within the hopper during a normal sweeping operation. The trajectory or path of the debris, such as sand, is defined between the dotted lines 48 and 50 and this debris will gather within the hopper along the bottom 28. The angle of repose is the angle at which debris may accumulate until the hopper is realistically full. Any further debris will not be held on the hopper bottom 28, but will simply slide down the pile of debris, past lip 34, and back into the path of the brush.

To provide additional loading capacity for the hopper, a shelf 52 is attached between the side walls 32 and is attached to the front wall 30. The shelf is indicated in detail in FIGS. 4 and 5 and includes a bottom wall 54, a back wall 56, and a front wall 58. Sides 60 will be used to attach the shelf to the side walls 32 of the hopper. The front 58 of the shelf will be attached to the front wall 30 of the hopper. The dotted line indicated at 62 in FIG. 3 indicates the accumulation of debris on the shelf 52, again relative to the angle of repose, as the material accumulating on the shelf can have no greater angle of repose than that for the bottom wall 28. The back wall 56 may function as a retainer holding debris on the shelf 52.

Although the invention illustrates a single shelf attached between the side walls, obviously with larger hoppers, especially hopper which might be higher, there may be multiple such shelves extending between the side walls and there may also be shelves which extend along one or both of the side walls. What is important is to increase the capacity for debris and it has been determined that using a shelf such as shown in the drawings herein increases the debris capacity of a typical hopper from approximately 90 lbs. to approximately 120 lbs., when sand is the major portion of the debris. The debris will follow the trajectory between the lines 48 and 50 and as can be seen from FIG. 3, this debris will accumulate both on the bottom 28, up to the angle of repose indicated by line 46, and on shelf 52 up to the angle of repose indicated by line 62. Both the shelf and the hopper bottom will fill simultaneously, as the trajectory of the debris is adequate to direct debris to both of these holding elements.

Whereas the preferred form of the invention has been shown and described herein, it should be realized that there may be many modifications, substitutions and alterations thereto.

The embodiments of the invention in which an exclusive property or privilege is claimed are defined as follows:

1. A sweeping machine having a body, wheels supporting said body, a sweeping brush carried by said body and motor means on said body for rotating said brush in a predetermined direction, a debris hopper positioned adjacent said brush to receive debris moved by said brush toward said hopper, said hopper having a bottom, a front wall, and side walls, and a shelf in said hopper spaced above said bottom and attached to at least one of said walls, debris moved by said brush toward said hopper being deposited on both said hopper bottom and said hopper shelf.

2. The sweeping machine of claim 1 wherein said shelf extends between and is attached to said side walls.

3. The sweeping machine of claim 2 wherein said shelf is attached to said front wall.

4. The sweeping machine of claim 1 further including means attached to said machine for scrubbing a floor surface and located adjacent to said rotating brush.

5. The sweeping machine of claim 1 wherein said shelf is spaced above said hopper bottom a distance greater than the maximum height of the debris deposited on said hopper bottom.

6. The sweeping machine of claim 1 wherein said shelf has a retainer facing toward said brush.

* * * * *